United States Patent [19]
Matsuda
[11] 4,452,169
[45] Jun. 5, 1984

[54] REVIVING APPARATUS FOR FLUID PASSAGES

[75] Inventor: Shinichi Matsuda, 32-14, Higiriyama 1-chome, Konan-ku, Yokohama 233, Japan

[73] Assignees: Shinich Matsuda; Marubeni Construction Machinery Sales, Inc., both of Tokyo, Japan

[21] Appl. No.: 413,083

[22] Filed: Aug. 30, 1982

[51] Int. Cl.³ ..... B05C 7/02
[52] U.S. Cl. ..... 118/50; 118/72; 118/DIG. 10; 118/317; 51/411
[58] Field of Search ..... 118/72, Dig. 10, 317, 118/50; 51/411; 427/238

[56] References Cited

U.S. PATENT DOCUMENTS 3,073,687 1/1963 McCune ..... 51/317
3,485,671 12/1969 Stephens ..... 51/411 X
4,089,998 5/1978 Gibson ..... 118/DIG. 10 X
4,327,132 4/1982 Shinno ..... 427/236 X

*Primary Examiner*—John P. McIntosh
*Attorney, Agent, or Firm*—Schwartz & Weinrieb

[57] ABSTRACT

In a reviving apparatus for a fluid passage has a device for passing fluid through the fluid passage, at least one rotational flow making device for making rotational flow of the fluid, and at least one reviving material supplying device for supplying of reviving material so as to be carried by the fluid made rotational flow thereof, the rotational flow making device has a discharge pipe which is to be connected to one end of the fluid passage at outlet end thereof, a fluid chamber which surrounds the inlet end of the discharge pipe and has an inlet portion of the fluid, and a plurality of nozzles which are elongated from the fluid chamber into the dischage pipe through the wall of the discharge pipe so as to be inclined in the same rotational direction around the axis of the discharge pipe.

13 Claims, 5 Drawing Figures

REVIVING APPARATUS FOR FLUID PASSAGES

FIELD OF INVENTION

This invention relates to a reviving apparatus for a fluid passage which is made of metal pipes and is used for passing water, gas, oil or the like therethrough. The fluid passage may be a piping embedded in a building, a pipeline or the like.

BACKGROUND OF THE INVENTION

A reviving apparatus of a pipeline is disclosed in U.S. Pat. No. 3,073,687. The apparatus supplies rotational gas flow suspended with sand through the pipeline for cleaning of the pipeline. The apparatus has a device for making rotational gas flow using many pipes, therefore the device is a complicated structure and a large rotational gas flow cannot be obtained. A lining method of a pipe is also disclosed in U.S. Pat. No. 4,327,132. In the method, epoxy resin paint is supplied by a rapid air stream, but the air stream is not a rotational air flow, therefore the lining is not perfect.

OBJECTS OF THE INVENTION

Accordingly, one object of the present invention is to provide a reviving apparatus for a fluid passage, the apparatus has a compact structure and enables one to produce a large rotational fluid flow.

Another object of the present invention is to provide a new apparatus which enables one to reduce the large sound created when making rotational fluid flow.

SUMMARY OF THE INVENTION

The present invention provides a reviving apparatus for a fluid passage having means for passing fluid through the fluid passage, at least one rotational flow making device for making rotational flow of the fluid, and at least one reviving material supplying device for supplying of reviving material so as to be carried by the fluid made rotational flow thereof, wherein the rotational flow making device has a discharge pipe which is to be connected to one end of the fluid passage at outlet end thereof, a fluid chamber which surrounds the inlet end of the discharge pipe and has an inlet portion of the fluid, and a plurality of nozzles which are elongated from the fluid chamber into the discharge pipe passing through the wall of the discharge pipe so as to be inclined in the same rotational direction around the axis of the discharge pipe.

BRIEF DESCRIPTION OF DRAWINGS

Other objects, features, and attendant advantages of the present invention will be more clear by following description referring to accompanying drawings wherein.

DETAILED DESCRIPTION

Figure 1:
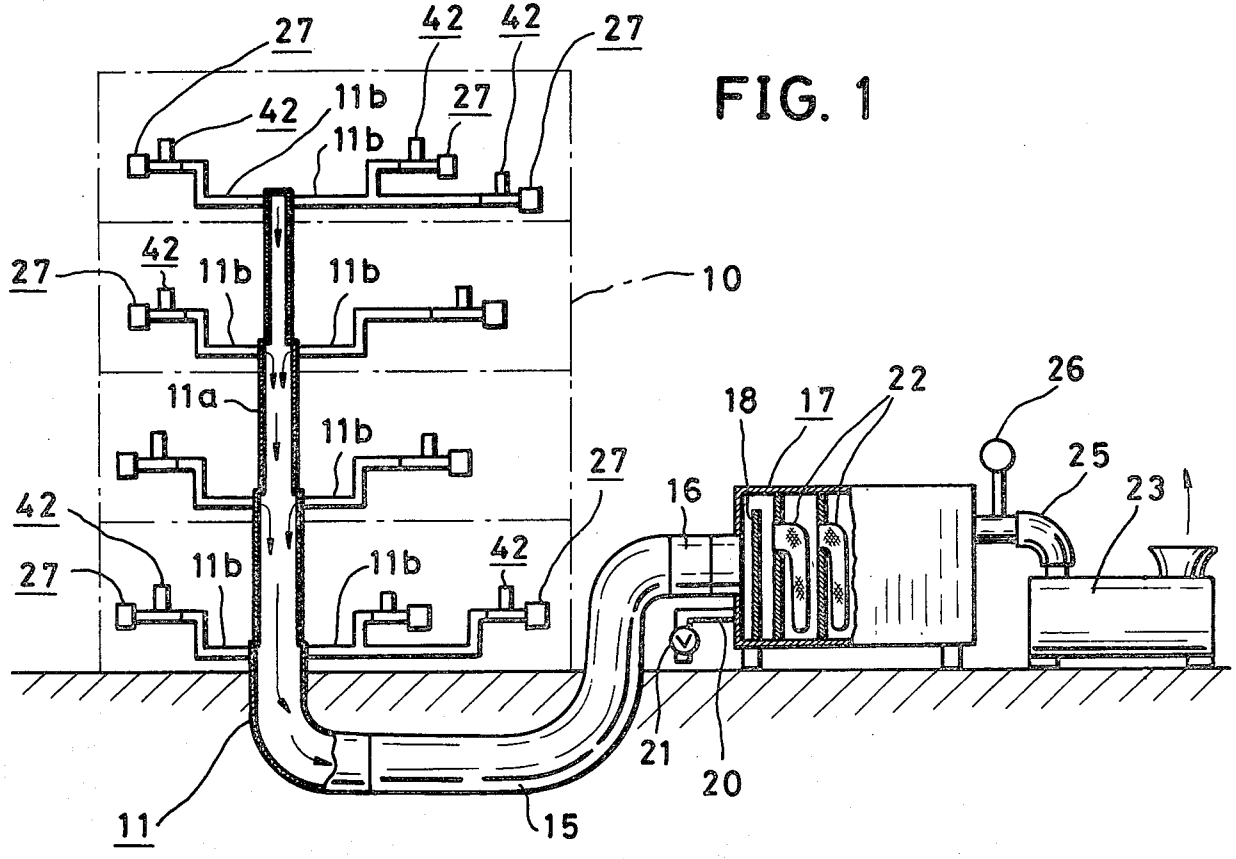
FIG. 1 illustrates a using condition of an embodiment of the present invention partially cut away.

In an embodiment of the present invention shown in FIG. 1, 10 designates a building which has a fluid passage 11 for reviving by an apparatus of the present invention. The fluid passage 11 includes a vertical portion 11*a* which consists of a plurality of metal pipes and a plurality of branched portions 11*b*. A hose 15 is connected to the lower end of the vertical portion 11*a* at one end thereof. A transparent tubular member 16 is connected to the other end of the hose 15 at a position above the ground surface. A dust collector 17 is connected to the tubular member 16 at an inlet portion thereof and has a plate 18 so that sand and water encountering the plate fall down. A pipe 20 is provided to discharge the water in the dust collector 17 and has a valve 21. The dust collector 17 also has a plurality of filters 22 positioned in series for filtering sand, rust and scale. A suction device 23 is connected to the outlet side of the dust collector 17 by means of a hose 25 and makes an air flow through the fluid passage 11 as shown by arrow heads. The suction device 23 may be a jet engine having a silencer or a propeller fan. 26 designates a pressure gauge. At each branched portion 11*b*, a rotational flow making device 27 and a reviving material supplying device 42 are provided as a structure connected to each other.

Figure 2:
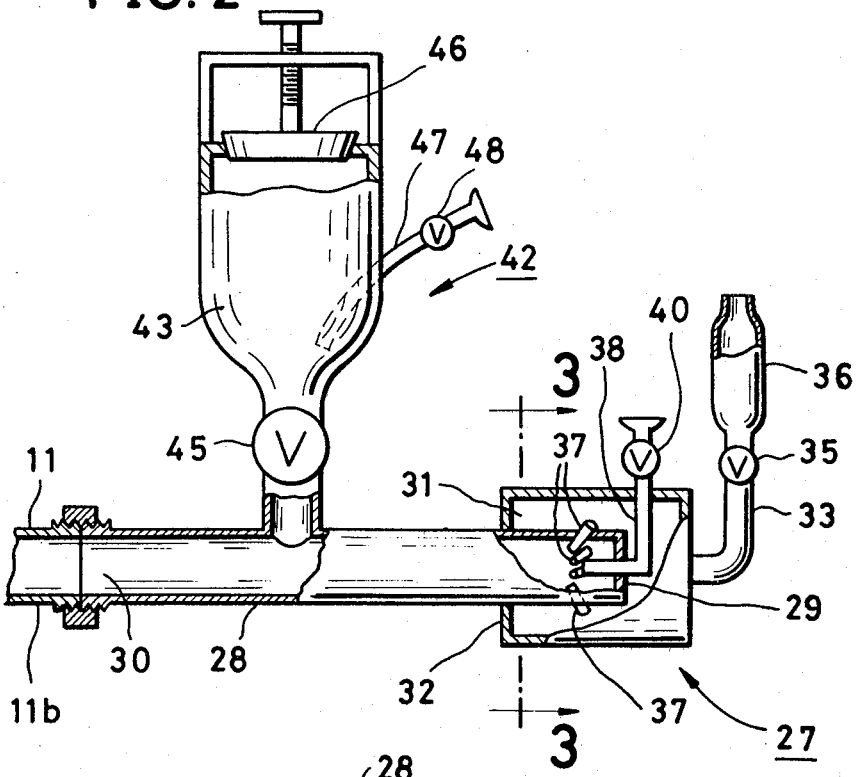
FIG. 2 is a side view of a rotational flow making device and a reviving material supplying device partially cut away.
Figure 3:
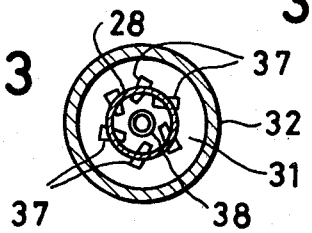
FIG. 3 is a sectional view taken along the line 3—3 of FIG. 2.

Referring now to FIGS. 2 and 3, there is shown the rotational flow making device 27. The device has a discharge pipe 28 having an end plate 29 at the inlet side thereof and an outlet port 30 which is to be connected to one of the branched portions 11*b* of the fluid passage 11. A fluid chamber 31 is provided so as to surround the inlet end of the discharge pipe 28 by means of a casing 32 and has an inlet portion 33 having a valve 35 and a silencer 36 at the inlet end thereof. A plurality of nozzles 37 are enlongated from the fluid chamber 31 into the discharge pipe 28 through the wall of the discharge pipe so as to be inclined in the same rotational direction around the axis of the discharge pipe 28. When the suction device 23 is driven, the inner space of the discharge pipe 28 connected to the fluid passage 11 becomes vacuum so that air is flowed into the discharge pipe 28 from the outer atmosphere through the inlet portion 33, the fluid chamber 31 and the nozzles 37, wherein a large rotational flow is created by the nozzles 37. A suction pipe 38 is elongated from the outer atmosphere into the discharge pipe 28 through the casing 32 and the end plate 29 of the discharge pipe 28 and is opened at a portion surrounded by the outlet openings of the nozzles 37 and has a valve 40. When air is flowed through the nozzles 37 and the valve 40 is opened, a large quantity of air is suctioned through the suction pipe 38 owing to the vacuum formed by high speed air flow through the nozzles 37 so that the air flow through the discharge pipe 28 and the fluid passage 11 is largely increased. The casing 32 effectively reduces the large sound created at nozzles 37 by the air flow therethrough, Referring now again to FIG. 2, there is also shown the reviving material supplying device 42 which has a tank 43 connected to the discharge pipe 28 at lower end thereof. A valve 45 is provided between the tank 43 and the discharge pipe 28. The tank 43 has a lid 46 which releasably covers the upper surface of the tank. A pipe 47 is elongated through the wall of the tank 43 from the outer atmosphere into the tank and has a valve 48. The tank 43 is used for containing sand and epoxy resin paint selectively as reviving materials.

When the suction device 23 is driven in a condition wherein sand is contained in the tank 43 of each reviving material supplying device 42 and the valve 35 of each rotational flow making device 27 is opened, the rotational air flow with high speed is created in the discharge pipe 28 and passes through the branched portion 11*b* and the vertical portion 11*a* of the fluid passage 11. If the valve 40 is opened, the quantity of the air flow is increased. In such condition, the valves 45 and 48 are opened so that the sand contained in the tank 43 is supplied into the discharge pipe 28 by means of the air flow suctioned through the pipe 47. The sand supplied in the discharge pipe 28 is carried by the rotational air flow and passes through the fluid passage 11. Therefore, the sand makes spiral movement along the inner surface of the fluid passage 11 so that rust, scale and other matter attached to the inner surface of the fluid passage 11 are removed with the sand from the fluid passage. Thus, the cleaning of the fluid passage 11 is obtained. The dust collector 17 removes the sand, rust, scale or the like from the air flow so that only the cleaned air is exhausted from the suction device 23. After the fluid passage 11 has been cleaned, the suction device 23 is to be stopped. In a condition wherein all of the sand in the tank 43 is consumed, epoxy resin paint mixed main material and hardening material by means of a mixing device (not shown) is contained in the tank 43. When the rotational air flow is again made through the discharge pipe 28 and the fluid passage 11 by means of the suction device 23 and the valves 45 and 48 are again opened, the paint is supplied into the discharge pipe 28 and passes through the fluid passage 11. The paint is elongated to become a spiral configuration and is received a large centrifugal force by the rotational movement so that the paint adheres to the inner surface of the fluid passage 11 and becomes lining layer. When the paint has been observed at the tubular member 16, the lining of the fluid passage 11 has been finished. Then, the valves 45 and 48 are closed and the suction device 23 is stopped. After the lining of the fluid passage 11 has been finished, the passage is dried by natural air flow or an air flow made by means of the suction device 23 passing therethrough.

In the embodiment of the present invention shown in FIGS. 1–3, it is possible to use only one rotational flow making device 27 so as to connect to the branched portions 11*b* one by one. In such case, the branched portions which are not connected with the rotational flow making device 27 may be opened for increasing the air quantity in the vertical portion 11*a*. It is also possible that the rotational flow making device 27 and the reviving material supplying device 42 are made as separate structures and are connected by a hose. The discharge pipe 28 may be connected to the fluid passage 11 by means of a suitable hose.

Figure 4:
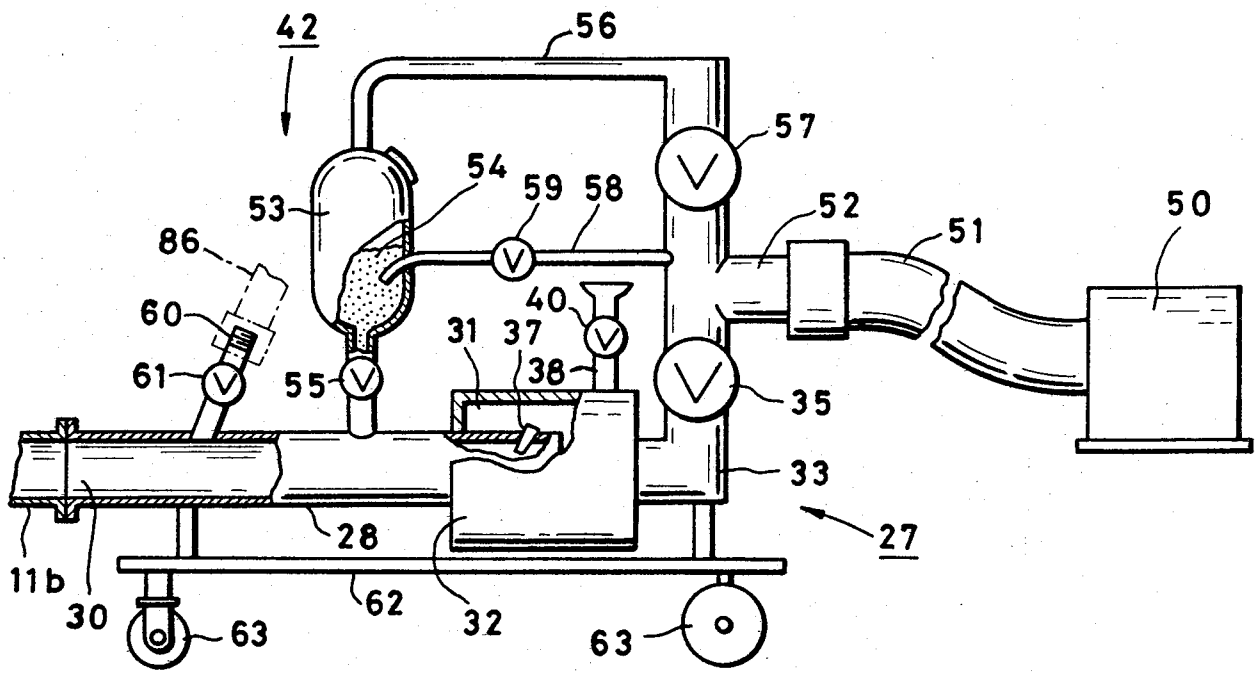
FIG. 4 is a side view of a rotational flow making device and a reviving material supplying device in another embodiment of the present invention partially cut away.
Figure 5:
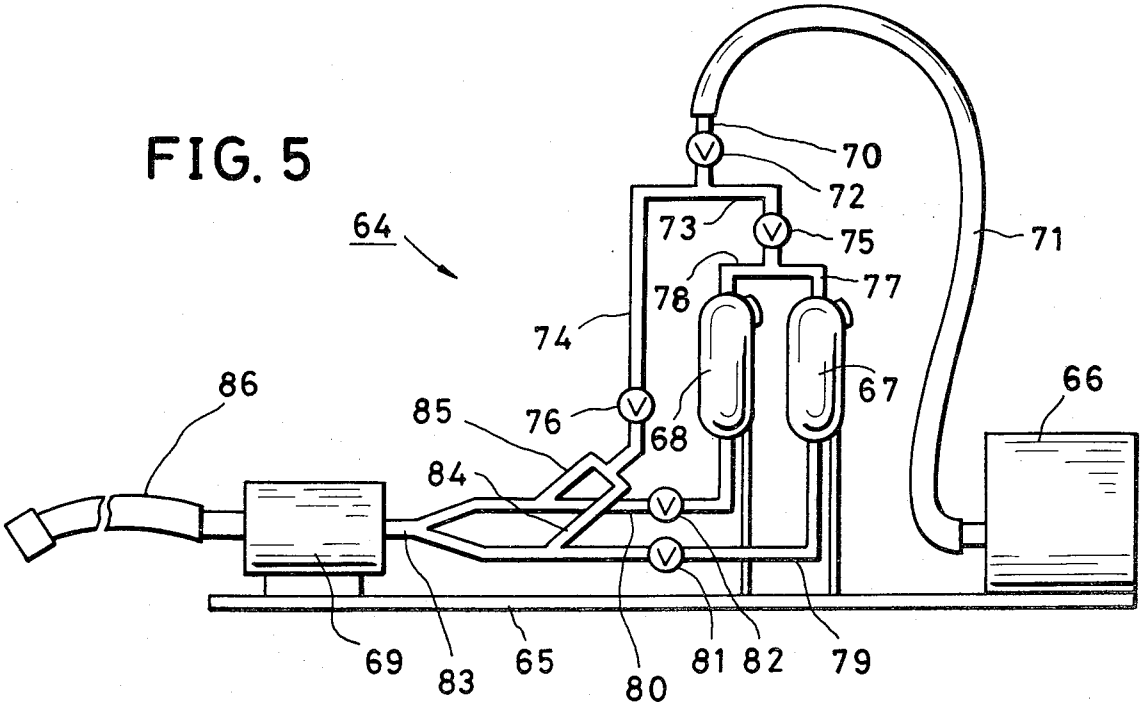
FIG. 5 is a side view of an epoxy resin paint feeder for use in the embodiment shown in FIG. 4.

Referring now to FIGS. 4 and 5, there is shown another embodiment of this invention. The apparatus of the embodiment does not have a suction device and has a compressed air source 50 which may be an air compressor or a tank supplied compressed air thereto by means of a compressor. The apparatus has a rotational flow making device 27 which is substantially similar to that of the preceding embodiment so that a rotational air flow is to be made in the discharge pipe 28 and in the fluid passage 11. The rotational flow making device 27 of the apparatus does not have a silencer such as that of the preceding embodiment. Therefore, a hose 51 is connected between the compressed air source 50 and a connecting portion 52 of the inlet portion 33. In use of the apparatus, the air passed through a dust collector (not shown) is to be directly exhausted in the atmosphere. The apparatus has a reviving material supplying device 42 which has a tank 53 for containing only sand 54. The tank 53 is connected to the discharge pipe 28, a valve 55 is provided therebetween. A pipe 56 is elongated from the connecting portion 52 to the upper portion of the tank 53 and has a valve 57. A pipe 58 is elongated from the connecting portion 52 into the tank 53 and is opened at lower portion in the tank and has a valve 59. When the rotational air flow is made through the discharge pipe 28 and the fluid passage 11 and the valves 55, 57, 59 are opened, the sand 54 in the tank 53 is supplied in the rotational air flow and makes cleaning of the fluid passage 11. The reviving material supplying device 42 also has a connecting port 60 projecting from the discharge pipe 28 and having a valve 61 for supplying epoxy resin paint therethrough. A base 62 is provided for supporting the rotational flow making device 27 and the reviving material supplying device 42 and has wheels 63. An epoxy resin paint feeder 64 is shown in FIG. 5. The feeder 64 has a base 65 and an air compressor 66. A pair of tanks 67 and 68 for containing main material and hardening material respectively are supported by appropriate supporting members fixed on the base 65. A mixer 69 is provided on the base 65 and is to be driven by a motor (not shown). A pipe 70 is connected to the compressor 66 by means of a hose 71 and has a valve 72 and is branched to a pair of pipes 73 and 74 at lower end thereof. The pipes 73 and 74 have valves 75 and 76 respectively. The lower end of the pipe 73 is branched to a pair of pipes 77 and 78 which are connected to the upper ends of the tanks 67 and 68 respectively. A pair of pipes 79 and 80 are connected to the lower ends of the tanks 67 and 68 respectively and have valves 81 and 82 respectively. The other ends of the pipes 79 and 80 are connected to a pipe 83 which is connected to the inlet of the mixer 69. The lower end of the pipe 74 is branched to a pair of pipes 84 and 85 which are connected to the pipes 79 and 80 respectively. A hose 86 is connected to the outlet of the mixer 69 at one end thereof and another end thereof is to be releasably connected to the connecting port 60. When the compressor 66 and the mixer 69 are driven and the valves 72, 75, 76, 81, 82 are opened, the main material in the tank 67 and the hardening material in the tank 68 are supplied into the mixer 69 by compressed air and are mixed in the mixer. By the compressed air passed through the respective pipes 84 and 85, the main material and the hardening material are accelerated. The mixed epoxy resin paint by the mixer 69 is to be supplied into the discharge pipe 28 passing through the hose 86 and the connecting port 60 wherein the valve 61 is opened. Thus the lining of the fluid passage 11 can be obtained.

In case of reviving of a fluid passage which was used for passing oil or other burnable liquid therethrough, water can be supplied as working fluid with sand using the rotational flow making device 27 and the reviving material supplying device 42 shown in FIG. 4 for preliminary cleaning of the fluid passage.

The foregoing is of course considered as illustrative only of the principle of the invention. Obviously, numerous modifications of the present invention are possible in light of the above teachings.

I claim:

1. Apparatus for reviving the interior surface of a fluid passage, comprising:

fluid conduit means fluidically connected to said fluid passage for introducing a carrier fluid into said fluid passage;

means for introducing said carrier fluid into said fluid conduit means;

single manifold means surrounding said fluid conduit means and interposed between said fluid conduit means and said introducing means for fluidically connecting said fluid conduit means and said introducing means;

a plurality of nozzles fixedly mounted upon said fluid conduit means and disposed within said single manifold means, for fluidically connecting said fluid conduit means and said single manifold means and, for imparting to said carrier fluid a spirally rotative flow pattern within said fluid conduit means and said fluid passage; and means for fluidically connecting a supply of reviving material with said fluid conduit means for introduction into said spirally rotatively flowing carrier fluid within said fluid conduit means for transmission in said spirally rotative flowing pattern into said fluid passage for revival of the interior surface of said fluid passage.

2. Apparatus as set forth in claim 1, wherein:

said plurality of nozzles pass through the side wall portions of said fluid conduit means.

3. Apparatus as set forth in claim 1, wherein:

each of said plurality of nozzles is disposed at the same predetermined angle relative to the sidewalls of said fluid conduit means.

4. Apparatus as set forth in claim 1, wherein:

said introducing means comprises vacuum suction means fluidically connected to said fluid passage.

5. Apparatus as set forth in claim 1, wherein:

said introducing means comprises a source of pressurized air.

6. Apparatus as set forth in claim 1, wherein:

said reviving material comprises sand.

7. Apparatus as set forth in claim 1, wherein:

said reviving material comprises epoxy resin paint.

8. Apparatus as set forth in claim 1, wherein:

said fluid passage comprises a main pipe and a plurality of branch pipes fluidically connected to said main pipe.

9. Apparatus as set forth in claim 8, wherein:

said introducing means comprises additional means fluidically connected to one end of said main pipe.

10. Apparatus as set forth in claim 9, wherein:

said additional means comprises vacuum suction means.

11. Apparatus as set forth in claim 8, wherein:

said fluid conduit means is fluidically connected to each of said branch pipes.

12. Apparatus as set forth in claim 11, wherein:

said introducing means comprises a source of pressurized air.

13. Apparatus as set forth in claim 1, wherein:

said nozzles are disposed in a circumferential array about the longitudinal axis of said fluid conduit means.

* * * * *